US006304225B1

(12) United States Patent
Hemmi

(10) Patent No.: US 6,304,225 B1
(45) **Date of Patent: *Oct. 16, 2001**

(54) LENS SYSTEM FOR ANTENNA SYSTEM

(75) Inventor: Christian O. Hemmi, Plano, TX (US)

(73) Assignee: Raytheon Company, Lexington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/138,821

(22) Filed: Aug. 21, 1998

(51) Int. Cl.[7] ..... H01Q 19/06

(52) U.S. Cl. ..... 343/753; 343/254; 343/911 R; 343/911 L

(58) Field of Search ..... 343/753, 754, 343/911 R, 911 L; H01Q 19/06

(56) References Cited

U.S. PATENT DOCUMENTS

| | | | | |
|---|---|---|---|---|
| 3,133,285 | * | 5/1964 | Jordan et al. | 343/911 |
| 3,761,936 | | 9/1973 | Archer et al. | 343/754 |
| 3,993,999 | | 11/1976 | Hemmi et al. | 343/854 |
| 4,100,548 | | 7/1978 | Hemmi et al. | 343/837 |
| 4,381,509 | | 4/1983 | Rotman et al. | 343/754 |
| 4,721,966 | * | 1/1988 | McGrath | 343/754 |
| 4,769,646 | | 9/1988 | Raber et al. | 343/753 |
| 5,327,147 | | 7/1994 | Caille et al. | 343/700 MS |
| 5,548,294 | | 8/1996 | Sturza | 342/372 |

(List continued on next page.)

FOREIGN PATENT DOCUMENTS

| | | |
|---|---|---|
| 0 373 257 A1 | 12/1988 | (EP) . |
| 0 707 356 A1 | 4/1994 | (EP) . |
| 0 793 291 A2 | 2/1997 | (EP) . |
| 0 803 930 A2 | 10/1997 | (EP) . |
| 2.045.714 | 5/1971 | (FR) . |
| 2 191 344 A | 12/1987 | (GB) . |
| 2 205 996 A | 12/1988 | (GB) . |
| 2 315 644 A | 2/1998 | (GB) . |
| 61-052007 | 3/1986 | (JP) . |
| 63-142905 | 6/1988 | (JP) . |
| WO 98/10305 | 3/1998 | (WO) . |

OTHER PUBLICATIONS

J. Paul Shelton, "Focusing Characteristics of Symmetrically Configured Bootlace Lenses," IEEE Transactions on Antennas and Propagation, vol. AP–26, No. 4, pp. 513–518, Jul. 1978.

David T. Thomas, "Multiple Beam Synthesis of Low Sidelobe Patterns in Lens Fed Arrays," IEEE Transactions on Antennas and Propagation, vol. AP–26, No. 6, pp. 883–886, Nov. 1978.

R. Gupta, A. Zaghloul, T. Hampsch, and F. Assal, "Development of a Beam–Forming Matrix Using MMICs for Multibeam Active Phased Arrays," IEEE 1994 APS International Symposium, vol. 2, pp. 844–847.

E.P. Ekelman, E.C. Kohls, A.I. Zaghloul, and F.T. Assal, "Measured Performance of a Ku–Band Multibeam High–Power Phased–Array," IEEE APS International Symposium, pp. 852–855, Jun. 1994.

A.G. Roederer, N.E. Jensen, and G.A.E. Crone, "Some European Satellite–Antenna Developments and Trends," IEEE Antennas and Propagation Magazine, vol. 38, No. 2, pp. 9–19, Apr. 1996.

Richard C. Johnson, "Antenna Engineering Handbook," Third Ed., pp. 18–2 to 18–7.

*Primary Examiner*—Don Wong
*Assistant Examiner*—Shih-Chao Chen
(74) *Attorney, Agent, or Firm*—Baker Botts L.L.P.

(57) ABSTRACT

An antenna system (30) includes a lens (40, 50) and a plurality of non-uniform feed elements (42, 52). The non-uniform feed elements (42, 52) are coupled to the lens system and operable to shape each of a plurality of beams (32) to match an angular size of a ground-based cell (20) assigned to the beam (32).

23 Claims, 2 Drawing Sheets

U.S. PATENT DOCUMENTS

| | | | | |
|---|---|---|---|---|
| 5,576,721 | | 11/1996 | Hwang et al. | 343/753 |
| 5,621,415 | | 4/1997 | Tuck | 342/354 |
| 5,642,122 | | 6/1997 | Lockie et al. | 343/881 |
| 5,650,788 | | 7/1997 | Jha | 343/700 MS |
| 5,677,796 | * | 10/1997 | Zimmerman et al. | 359/654 |
| 5,736,959 | * | 4/1998 | Patterson et al. | 342/354 |
| 5,936,588 | * | 8/1999 | Rao et al. | 343/754 |
| 6,160,519 | * | 12/2000 | Hemmi | 343/753 |

* cited by examiner

LENS SYSTEM FOR ANTENNA SYSTEM

RELATED APPLICATIONS

This application is related to copending U.S. patent application Ser. No. 09/138,238 filed Aug. 21, 1998 entitled "TWO-DIMENSIONALLY STEERED ANTENNA SYSTEM" , and to copending U.S. patent application Ser. No. 09/452,019 entitled "MULTI-LEVEL SYSTEM AND METHOD FOR STEERING AN ANTENNA" (Attorney's Docket No. 004578.0991).

TECHNICAL FIELD OF THE INVENTION

This invention relates generally to satellite antenna systems and more particularly to an improved lens system for an antenna system.

BACKGROUND OF THE INVENTION

Communications networks employ satellites operating in geosynchronous orbits in combination with terrestrial facilities such as land lines, microwave repeaters, and undersea cables to provide communications over vast areas of the earth. Geosynchronous satellites and terrestrial facilities are both expensive to install and to maintain and thus are not a cost effective means of increasing network capacity. In addition, geosynchronous satellites which operate at an altitude of 22,300 miles above the earth are unsuitable for supporting cellular service because of the extremely high power levels that would be required to communicate with satellites at that altitude.

More recently, constellations of low earth orbit (LEO) satellites have been proposed and are being developed as a cost effective means for providing increased capacity and supporting cellular and broadband data service for communications networks. In such a constellation, the satellites are divided into a number of orbital planes. Because low earth orbit satellites move rapidly with respect to the earth, each orbital plane includes a number of satellites that maintain continuous coverage for underlying cells defined on the surface of the earth. A footprint of cells represent the coverage region for each satellite.

Low earth orbit satellites utilize antennas which form a cluster of beams each assigned a ground-based cell. Due to the geometry of low earth satellites above the spherical surface of the earth, cells near the edges of the footprint have a much smaller angular size and closer angular spacing than cells near the center of the footprint. To accurately process signals from the cells, the antenna shapes each beam to match the angular size of its assigned cell. Existing beam shaping systems utilize phase shifting devices that greatly increase the complexity of the antenna and thus the cost of the satellite.

SUMMARY OF THE INVENTION

In accordance with the present invention, an improved lens system and method for an antenna are provided that substantially eliminate or reduce disadvantages and problems associated with previously developed systems and methods. In particular, the present invention provides a lens system that uses non-uniform feed elements to shape beams to match the angular size of ground-based cells.

In one embodiment of the present invention, an antenna system includes a lens and a plurality of non-uniform feed elements. The non-uniform feed elements are coupled to the lens and operable to shape each of a plurality of beams to match an angular size of a ground-based cell assigned to the beam.

More specifically, in accordance with a particular embodiment of the present invention, the feed elements are non-uniform in that they are differently sized and variably spaced. The lens may be a spherical dielectric lens such as a Luneberg lens, a planar lens such as a Rotman lens, or other suitable lens.

Technical advantages of the present invention include providing an improved lens system. In particular, the lens system includes a plurality of non-uniform feed elements that shape beams to match the angular size of ground-based cells. Accordingly, the beams are shaped without phase shifting or other processing intensive methods. In addition, a substantially equal number of component beams are maintained for each ground-based cell. As a result, the total number of component beams needed to cover a cell footprint is reduced, which correspondingly reduces the number of feed elements and other components in the antenna beamforming network. Accordingly, the complexity and cost of the antenna is reduced.

BRIEF DESCRIPTION OF THE DRAWINGS

For a more complete understanding of the present invention and its advantages, reference is now made to the following description taken in conjunction with the accompanying drawings, in which.

DETAILED DESCRIPTION OF THE INVENTION

Figure 1:
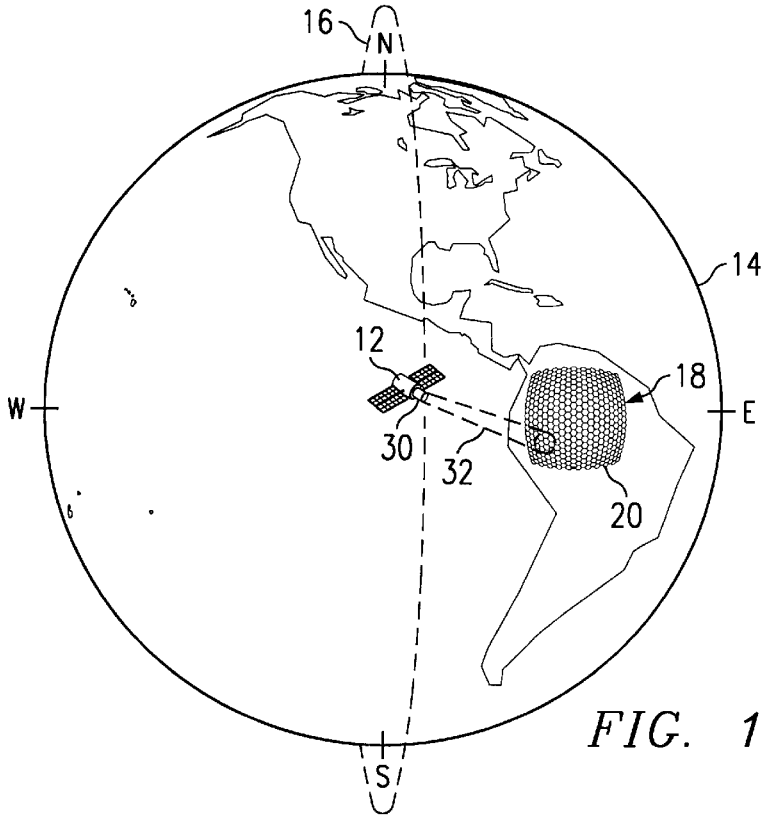
FIG. 1 is a schematic diagram illustrating a satellite in low earth orbit (LEO) in accordance with one embodiment of the present invention.

FIG. 1 illustrates a satellite 12 orbiting the earth 14 in a low earth orbit 16 and projecting a satellite footprint 18 onto a fixed grid of ground-based cells 20. The low earth orbit (LEO) satellite 12 forms part of a constellation of similar satellites that provide continuous coverage for the ground-based cells 20. In the constellation, the satellites are spaced apart in a plurality of orbital planes, with each orbital plane having a necessary number of satellites to provide continual coverage for the cells underlying that orbital plane. Thus, each satellite 12 immediately follows another satellite in its orbital plane and is itself immediately followed by still another satellite in that orbital plane. In one embodiment, for example, the constellation includes twenty-four (24) orbital planes with twelve (12) satellites in each orbital plane. In this exemplary embodiment, each satellite has an altitude of 1,350 kilometers, a footprint, or coverage area, 18, that is 1,660 kilometers by 1,660 kilometers, and an orbital period of about 112 minutes. It will be understood that the type, number, and orbital planes for the satellites 12 may be suitably varied.

Figure 2:
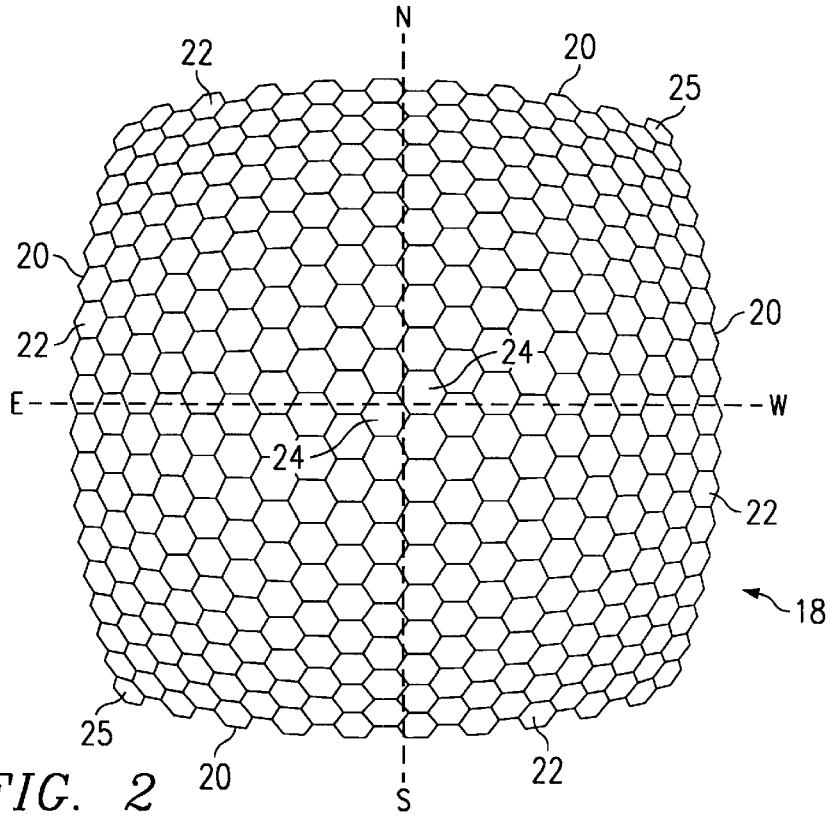
FIG. 2 is a schematic diagram illustrating ground-based cells within the coverage area for the satellite of FIG. 1.

FIG. 2 illustrates details of the ground-based cells 20 within the footprint 18. For the exemplary embodiment in which the footprint 18 is 1,660 kilometers by 1,660 kilometers in size, the footprint 18 includes 725 hexagonal-shaped cells 20. Each hexagonal cell is 78.7 kilometers across. The size and shape of the ground-based cells 20 may be suitably varied so long as the cells 20 fully cover the footprint 18. For example, the footprint 18 may be tiled with square or radial cells 20.

Due to the geometry of low earth satellites 12 above the spherical surface of the earth 14, cells 22 near the edges of the footprint 18 have a much smaller angular size and closer angular spacing than cells 24 near the center of the footprint 18. In the exemplary embodiment, for example, the cells 24 at the center of the footprint 18 have an angular size of 3.5 degrees while the cells 22 near the edges of the footprint 18 have an angular size of 2.4 degrees and the cells 25 at the corner of the footprint 18 have an angular size of 1.8 degrees.

Returning to FIG. 1, the satellite 12 includes a multi-beam antenna system 30 for communicating directly with a plurality of portable, mobile, and fixed terminals in the ground-based cells 20. Each beam 32 is assigned to a ground-based cell 20. As described in more detail below, the multi-beam antenna system 30 shapes each beam 32 so that the beam 32 matches the shape of the assigned ground-based cell 20. The antenna system 30 also steers each beam 32 so that the assigned ground-based cell 20 is illuminated by that beam 32 until the next beam 32 moves into position on that cell 20 or the next satellite 12 moves into position to illuminate the cell 20. Thus, the beams 32 are shaped to match the ground-based cells 20 and are steered to maintain alignment with the ground-based cells 20 during the time the satellite 12 moves one cell width along its orbit. After the satellite 12 has moved one cell width, the beams 32 are each ratcheted forward one cell width in the direction of flight and beams 32 are reassigned to the next set of cells in the flight direction. The set of cells 20 dropped by the satellite 12 are picked up by a following satellite 12. In this way, continuous coverage for the ground-based cells 12 is maintained.

The satellite antenna system 30 includes a lens system that receives and focuses component beam signals for the ground-based cells 20. As described in more detail below, the lens system includes one or more lenses and non-uniform feed elements coupled to the lens system to shape each beam 32 to match the angular size of the beam's assigned ground-based cell 20. As used herein, the term each means each of at least a subset of the specified elements. A beam 32 matches the angular size of its ground-based cell 20 when it closely approximates the size of the cell 20 as seen by the antenna system 30. For the exemplary embodiment having hexagonal cells 20, the beams 32 are circularly shaped to match cells 24 near the center of the footprint 18 and elliptically shaped to match cells 22 near the edge of the footprint 18.

The feed elements are non-uniform in that they are differently sized and variably spaced with respect to each other. In one embodiment, the feed elements are sized and spaced such that a substantially equal number of component beams are maintained for each ground-based cell 20. The particular size and spacing of the feed elements may vary depending on the lens type, footprint size, cell size and shape, and other suitable criteria.

Figure 3:
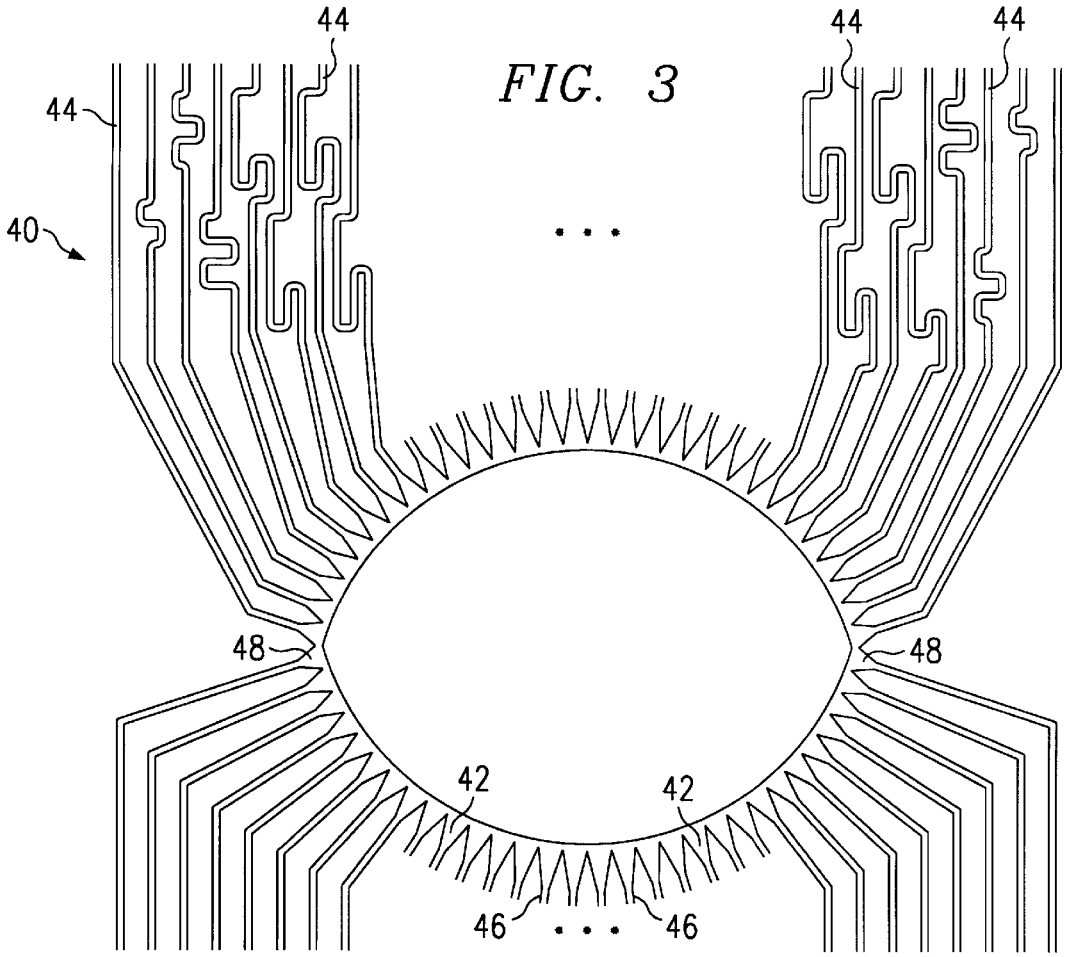
FIG. 3 is a schematic diagram illustrating a Stripline Rotman lens system with non-uniform feed elements for the satellite of FIG. 1.

FIG. 3 illustrates a planar lens 40 having non-uniform feed elements 42 in accordance with one embodiment of the present invention. In this embodiment, the lens system includes a plurality of planar lens arrays that each focus and shape component beam signals received from the ground-based cells 20 in one direction. As used herein, signal means signal received from ground-based cells 20 and any signal generated, formed from, or based on such signals.

The planar lens 40 is a parallel plate or other suitable lens having two-dimensional characteristics. The planar lens 40 is a Stripline Rotman lens, bi-focal pillbox lens, or other suitable two-dimensional lens. A Rotman lens is preferred because it has three focal points and thus better performance. For frequencies in the upper microwave region, the Rotman lens is constructed using microwave circuit board materials such as Duroid made by Rogers Corp. or similar materials. For the embodiment of FIG. 3, the planar lens 40 is a Stripline Rotman lens. The Stripline Rotman lens 40 includes a plurality of striplines 44 of varying lengths that focus the component beams in one direction. The feed elements 42 are disposed at the bottom of the Rotman lens 40 and collect the component beams that have been focused in the lens direction. The feed elements 42 are non-uniform in size and spacing in order to shape the beams 32 in the lens direction to match the angular size and spacing of the ground-based cells 20 in the lens direction. In particular, feed elements 46 near the center of the Rotman lens 40 that correspond to cells 24 near the center of the footprint 18 are larger and spaced further apart than feed elements 48 at the edges of the Rotman lens 40 that correspond to cells 22 near the edge of the footprint 18 in accordance with the angular size of the cells 20.

Figure 4:
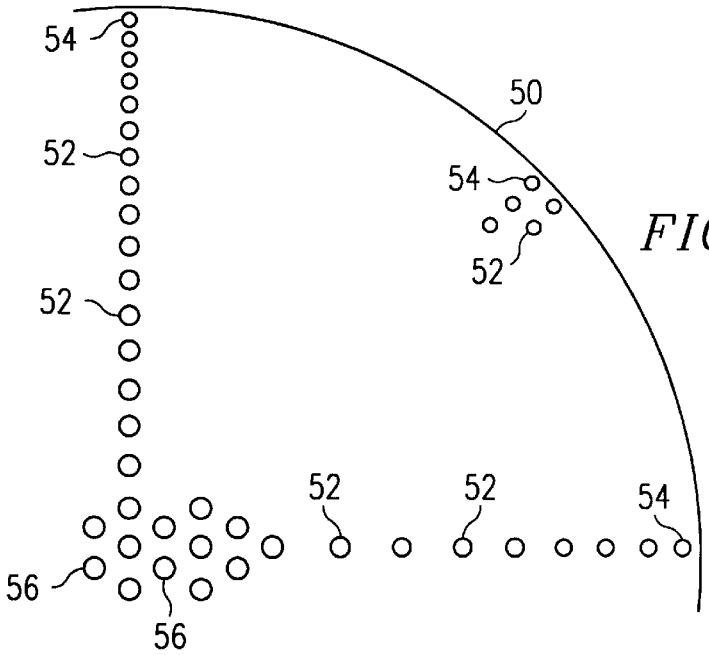
FIG. 4 is a schematic diagram illustrating a Luneberg lens system with non-uniform feed elements for the satellite of FIG. 1.

FIG. 4 illustrates a spherical dielectric lens 50 having non-uniform feed elements 52 in accordance with another embodiment of the present invention. The spherical dielectric lens 50 is a Luneberg or other suitable symmetrical lens. The Luneberg lens is made from concentric shells of dielectric material. The first shell has a nominal dielectric constant of 1.0, the center core has a dielectric constant of 2.0, and the intermediate shells vary uniformly between 1.0 and 2.0.

For the embodiment of FIG. 4, the spherical dielectric lens 50 is a Luneberg lens. The feed elements 52 are mounted to the surface of the Luneberg lens 50 opposite the field of view of the lens 50 to receive component beams focused by the lens 50. The feed elements 52 are non-uniform in size and spacing in order to shape the beams 32 to match the angular size of the ground-based cells 20. In particular, feed elements 54 corresponding to cells 22 at the edge of the footprint 18 are smaller and spaced more closely together than feed elements 56 corresponding to cells 24 at the center of the footprint 18.

By varying the size and spacing of feed elements in the lens system of the antenna 30, the component beams may be shaped without phase shifting. In addition, a substantially equal number of component beams are maintained for each ground-based cell 20. As a result, the total number of component beams needed to cover the footprint 18 is reduced, which correspondingly reduces the number of feed elements and other components in the beam-forming network. Accordingly, the complexity and cost of the antenna system 30 is reduced.

In addition to the low earth orbit satellite 12, the present invention may be used in connection with other systems that require multiple beams to be shaped. For example, the present invention can be used in combination with beam steering systems for geosynchronous communication satellites that use steerable spot beams, listening antennas such as ESM (Electronic Support Measures) antennas and transmit antennas such as ECM (Electronic Counter Measures) antennas. This invention can also be used for antennas mounted on aircraft, dirigibles, or other platforms that orbit or are stationed above cites to provide communication services.

Although the present invention has been described with several embodiments, various changes and modifications may be suggested to one skilled in the art. It is intended that the present invention encompass such changes and modifications as fall within the scope of the appended claims.

What is claimed is:

1. An apparatus, comprising an antenna system which includes beam shaping structure that is operable to shape each of a plurality of beams corresponding to respective ground-based cells, said beam shaping structure including:

a lens; and a plurality of non-uniform feed elements fixedly coupled to the lens.

2. An apparatus according to claim 1, wherein the non-uniform feed elements receive a substantially equal number of component beams for each of a plurality of ground-based cells.

3. An apparatus according to claim 1, wherein the non-uniform characteristic of the non-uniform feed elements relates to at least one of size, shape, and inter-element spacing of the feed elements.

4. An apparatus according to claim 1, wherein the lens includes a spherical dielectric lens.

5. An apparatus according to claim 4, wherein the spherical dielectric lens is a Luneberg lens.

6. An apparatus according to claim 1, wherein the lens includes a planar lens.

7. An apparatus according to claim 6, wherein the planar lens is a Rotman lens.

8. A method for shaping beams for an antenna system, comprising:

providing a lens;

fixedly coupling a plurality of non-uniform feed elements to the lens; and shaping with the non-uniform feed elements each of a plurality of beams which each correspond to a respective ground-based cell.

9. A method according to claim 8, including the step of causing the non-uniform feed elements to receive a substantially equal number of component beams for each of a plurality of ground-based cells.

10. A method according to claim 8, including the step of forming the non-uniform feed elements so that the non-uniform characteristic relates to at least one of size, shape, and inter-element spacing of the feed elements.

11. A method according to claim 8, including the step of using as the lens a spherical dielectric lens.

12. A method according to claim 11, including the step of using as the spherical dielectric lens a Luneberg lens.

13. A method according to claim 8, including the step of using as the lens a planar lens.

14. An apparatus according to claim 1, wherein said beam shaping structure is operable to carry out said so that each beam is shaped to match an angular size of a ground-based cell assigned to the beam.

15. An apparatus according to claim 1, including a low earth orbit satellite, said antenna system being a part of said satellite.

16. A method according to claim 8, wherein said shaping step includes the step of shaping each of the beams to match an angular size of the corresponding ground-based cell.

17. A method according to claim 8, including the step of providing the antenna system on a low earth orbit satellite.

18. An apparatus comprising a lens, and a plurality of non-uniform feed elements which are fixedly coupled to said lens, and which are operatively cooperable with said lens so as to facilitate a transfer of respective electromagnetic signals therebetween.

19. An apparatus according to claim 18, wherein the non-uniform characteristic of the non-uniform feed elements relates to at least one of size, shape, and inter-element spacing of the feed elements.

20. An apparatus according to claim 18, wherein the lens is a spherical dielectric lens.

21. An apparatus according to claim 20, wherein the spherical dielectric lens is a Luneberg lens.

22. An apparatus according to claim 18, wherein the lens is a planar lens.

23. An apparatus according to claim 22, wherein the planar lens is a Rotman lens.

* * * * *